US007637032B2

(12) United States Patent
Sokolowski et al.

(10) Patent No.: US 7,637,032 B2
(45) Date of Patent: Dec. 29, 2009

(54) FOOTWEAR STRUCTURE WITH TEXTILE UPPER MEMBER

(75) Inventors: Susan L. Sokolowski, Portland, OR (US); Susanne Amalie Wolf-Hochdoerffer, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 542 days.

(21) Appl. No.: 11/422,141

(22) Filed: Jun. 5, 2006

(65) Prior Publication Data

US 2007/0022627 A1 Feb. 1, 2007

Related U.S. Application Data

(60) Provisional application No. 60/703,512, filed on Jul. 29, 2005.

(51) Int. Cl.
*A43B 23/00* (2006.01)

(52) U.S. Cl. ..... 36/9 R; 36/45; 36/3 A

(58) Field of Classification Search ..... 36/9 R, 36/45, 3 A; 12/146 C, 142 G
See application file for complete search history.

(56) References Cited

U.S. PATENT DOCUMENTS

| | | | | |
|---|---|---|---|---|
| 2,147,197 | A | 2/1939 | Glidden | |
| 3,793,750 | A | 2/1974 | Bowerman | |
| 4,447,967 | A | 5/1984 | Zaino | |
| 4,756,098 | A | 7/1988 | Boggia | |
| 4,813,158 | A | 3/1989 | Brown | |
| 6,029,376 | A | 2/2000 | Cass | |
| 6,931,762 | B1 * | 8/2005 | Dua | 36/9 R |
| 7,000,257 | B2 | 2/2006 | Bevier | |
| 2004/0261295 | A1 * | 12/2004 | Meschter | 36/45 |
| 2005/0016023 | A1 | 1/2005 | Burris et al. | |
| 2005/0115284 | A1 | 6/2005 | Dua | |
| 2005/0193592 | A1 * | 9/2005 | Dua et al. | 36/45 |

FOREIGN PATENT DOCUMENTS

| | | | |
|---|---|---|---|
| WO | WO 2005120274 | A1 | 12/2005 |
| WO | WO 2006028664 | A1 | 3/2006 |

OTHER PUBLICATIONS

Partial International Search Report mailed Dec. 6, 2006.
U.S. Appl. No. 10/382,798, filed Mar. 5, 2003.

* cited by examiner

*Primary Examiner*—Ted Kavanaugh
(74) *Attorney, Agent, or Firm*—Banner & Witcoff, Ltd.

(57) ABSTRACT

Articles of footwear include a textile upper member with an exterior constructed from knitted textile material, the exterior including a region with stability ribs and a second unribbed region. The region(s) having stability ribs may be located, for example: along a lateral midfoot side of the upper member; along a forefoot portion of the upper member; and/or along a medial midfoot side of the upper member. Other articles of footwear include an upper member having exterior and interior textile elements joined together in a stitchless manner at the foot-receiving opening of the upper member. The exterior surface of this upper member also may include one or more regions with stability structures. The stitchless textile engagement techniques can provide a smooth, non-bulky, and breathable joint that does not require thick layers of textile material in contact with or adjacent the wearer's foot.

38 Claims, 10 Drawing Sheets

FOOTWEAR STRUCTURE WITH TEXTILE UPPER MEMBER

RELATED APPLICATION DATA

This application claims priority benefits based on U.S. Provisional Patent Appln. No. 60/703,512 filed Jul. 29, 2005. This provisional application is entirely incorporated herein by reference.

FIELD OF THE INVENTION

This invention relates generally to articles of footwear. More specific aspects of the invention relate to articles of footwear incorporating upper members at least partially formed from textile materials.

BACKGROUND

Conventional articles of footwear, e.g., athletic footwear, have included two primary elements, namely an upper member and a sole member. The upper member and the sole member, at least in part, define a foot-receiving chamber that may be accessed by a user's foot through a foot-receiving opening. The upper member provides a covering for the foot that securely receives and positions the foot with respect to the sole member. The upper member may extend around the ankle, over the instep and toe areas of the foot, along the medial and lateral sides of the foot, and around the heel area of the foot. In addition, the upper member may have a configuration that protects the foot and provides ventilation, thereby cooling the foot and removing perspiration.

The sole member generally is secured to a lower portion of the upper member and generally is positioned between the foot and the contact surface (any foot or footwear contact surface, including but not limited to: grass, dirt, snow, ice, tile, flooring, carpeting, synthetic grass, and the like). In addition to attenuating ground reaction forces, the sole member may provide traction and help control foot motion, such as excess pronation. Accordingly, the upper member and the sole members may operate cooperatively to provide a comfortable structure that is suited for a variety of ambulatory activities, such as walking and running.

The sole member of an article of footwear, in at least some instances, will exhibit a layered configuration that includes a comfort-enhancing insole, a resilient midsole (e.g., formed, at least in part, from a polymer foam material), and a surface-contacting outsole that provides both abrasion-resistance and traction. Suitable polymer foam materials for the midsole member include ethylvinylacetate ("EVA") or polyurethane ("PU") that compress resiliently under an applied load to attenuate ground reaction forces. Conventional polymer foam materials are resiliently compressible, in part, due to the inclusion of a plurality of open or closed cells that define an inner volume substantially displaced by gas.

SUMMARY

Aspects of this invention generally relate to articles of footwear. Articles of footwear in accordance with at least some examples of this invention may be particularly useful for various purposes or activities, such as yoga, pilates, stretching, dance, ballet, running, and the like, as well as for fashion footwear, slippers, etc. Such articles of footwear may place stability ribs or other stability-enhancing structures in or on the upper member at one or more regions or locations around the foot so as to anatomically place the stability regions at areas around the foot that need to be stabilized during the desired activities.

More specific examples of articles of footwear in accordance with at least some examples of this invention include: (a) an upper member substantially constructed from textile material, wherein an exterior of the upper member is substantially constructed from knitted textile material, the exterior including at least a first region having stability ribs (or other stability-enhancing structures) integrally formed in the knitted textile material and a second region continuous with the first region, the second region not including stability ribs (or other stability-enhancing structures); and (b) a sole member engaged with the upper member. The one or more regions including stability ribs (or other stability-enhancing structures) may be located, for example: along at least portions of a lateral midfoot side of the exterior of the upper member; along a forefoot portion of the exterior of the upper member; and/or along at least portions of a medial midfoot side of the exterior of the upper member.

Additional aspects of this invention relate to articles of footwear that include: (a) an upper member including a first textile element forming at least a major portion of an exterior surface of the upper member and a second textile element forming at least a major portion of an interior surface of the upper member, the first textile element joined to the second textile element in a stitchless manner at a foot-receiving opening of the upper member; and (b) a sole member engaged with the upper member. The exterior surface of the upper member may include one or more regions with stability ribs or other stability-enhancing structures, e.g., as described above. The stitchless textile engagement techniques used in accordance with at least some examples of this invention may provide a smooth, non-bulky, and breathable joint that does not result in excessively thick, stiff, and/or bulky layers of textile in contact with or adjacent the wearer's foot.

BRIEF DESCRIPTION OF THE DRAWINGS

A more complete understanding of the present invention and at least some features and advantages thereof may be acquired by referring to the following description and the accompanying drawings, in which like reference numbers indicate like features throughout, and wherein.

DETAILED DESCRIPTION

Figure 1A:
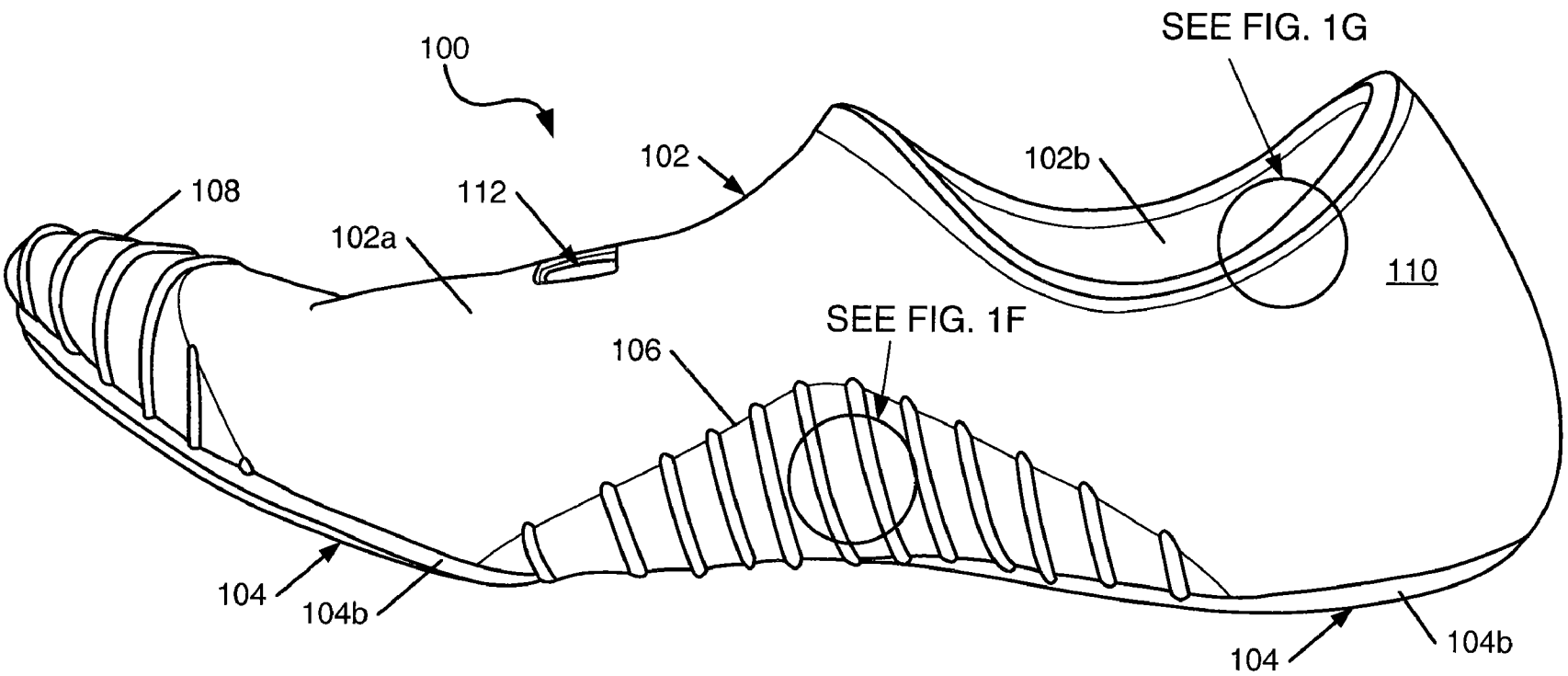
FIGS. 1A through 1H illustrate various views of an example article of footwear exhibiting at least some example structures and features in accordance with this invention.

In the following description of various examples of the present invention, reference is made to the accompanying drawings, which form a part hereof, and in which are shown by way of illustration various structures, embodiments, and examples in which aspects of the invention may be used and practiced. It is to be understood that other embodiments may be utilized and structural and functional modifications may be made without departing from the scope of the present invention.

I. General Description of Aspects of the Invention

Aspects of the present invention relate generally to articles of footwear. Articles of footwear in accordance with one example aspect of this invention include: (a) an upper member substantially constructed from textile material, wherein the upper member includes an exterior portion substantially constructed from knitted textile material, the exterior portion including a first region having stability ribs (or other stability-enhancing structures) integrally formed in the knitted textile material and a second region continuous with the first region, the second region not including stability ribs (or other stability-enhancing structures); and (b) a sole member engaged with the upper member.

The first region, including stability ribs or stability-enhancing structures, may be located in various positions without departing from this invention. In some examples, the stability-enhancing region(s) will be located at one or more anatomical positions in the upper member so as to provide support for the foot during use of the article of footwear, e.g., during yoga, pilates, stretching, dance, ballet, running, and the like, as well as for fashion footwear, slippers, etc. As more specific examples, at least one stability-enhanced region (e.g., the "first region") may extend along at least a portion of a lateral midfoot side of the exterior portion of the upper member (e.g., along a junction between the upper member and the sole member), and the second region (non-enhanced) may border along the first region (e.g., extend from one end of the stability-enhanced region to its opposite end). As still other examples, the stability-enhanced region may extend along a forefoot portion of the exterior portion of the upper member (e.g., across the toe area of the article of footwear), at least partially along a medial midfoot side of the exterior portion of the upper member, and in at least some examples, along the entire medial side of the article of footwear, from the toe portion to the rearfoot portion of the article of footwear. In some example structures, multiple, independent stability-enhanced regions may be provided, with the non-enhanced second region extending between the various stability-enhanced regions.

In accordance with at least some examples of this invention, the second (non-ribbed or non-enhanced) region may be located at various places without departing from this invention (e.g., at regions of the article of footwear corresponding to anatomical locations not requiring additional stability). As some more specific examples, the second region may extend at least partially across an instep portion of the exterior portion of the upper member or it may extend over a major portion of the lateral side of the upper member (e.g., along and adjacent a lateral side of a foot-receiving opening defined in the upper member).

In accordance with at least some example aspects of this invention, the upper member may include an interior portion opposite the exterior portion and at least partially defining a foot-receiving chamber, wherein the interior portion is constructed, at least in part, from an independent piece of textile material from that (or those) making the exterior portion of the upper member. This interior portion of the upper member may be constructed so as to not include stability ribs or other stability-enhancing structures at any location, or at least at an area corresponding to the first region of the exterior portion.

Articles of footwear according to at least some additional example aspects of this invention may include: (a) an upper member including a first textile element forming at least a major portion of an exterior surface of the upper member and a second textile element forming at least a major portion of an interior surface of the upper member, the first textile element joined to the second textile element in a stitchless manner at a foot-receiving opening of the upper member, and wherein the first textile element optionally is constructed from a knit textile material; and (b) a sole member engaged with the upper member. The exterior surface of the upper member may include one or more regions with stability ribs or other stability-enhancing structures, e.g., in the locations described above. Additionally, the interior surface of the upper member may be constructed so as not to include any stability ribs or other stability-enhancing structures, or at least to not include such structures at locations corresponding to stability-enhanced areas on the exterior surface. The stitchless textile engagement techniques used in accordance with at least some examples of this invention may provide a smooth, non-bulky, and breathable joint that does not result in thick layers of textile material in contact with or adjacent the wearer's foot.

Footwear structures in accordance with at least some examples of this invention further may include additional openings defined in the upper member structure (e.g., one or more openings independent of the foot-receiving opening, for example, located at an instep portion of the upper member between the foot-receiving opening and a forefoot or toe portion of the upper member). These additional openings, when present, may provide additional stretching and/or flexibility characteristics to the footwear upper member (e.g., for foot insertion, during use, etc.). If desired, the edges of the first textile material and/or the edges of the second textile material (when two materials are present) along one or more of these additional openings may be held together at a seam in a stitchless manner, e.g., in the manner that the textile materials are held together at the foot-receiving opening in at least some examples of this invention. The stitchless seam forming techniques can help prevent undesired fraying or unraveling of the textile edges at the opening(s).

II. Specific Examples Of The Invention

While aspects of the invention generally have been described above, the following detailed description, in conjunction with FIGS. 1A through 4, provides even more detailed examples of footwear structures and methods useful in accordance with examples of this invention. Those skilled in the art should understand, of course, that the following detailed description constitutes descriptions of examples of the invention and should not be construed as limiting the invention in any way.

A. Example Footwear Structures

FIGS. 1A through 1H illustrate an example structure of an article of footwear 100 according to at least some examples of this invention. While aspects of the invention may be applied to any articles of footwear or even to other products and/or for any desired end uses, the article of footwear 100 illustrated in the example of FIGS. 1A through 1H is a soft and flexible article of footwear including a textile upper member, e.g., of the type used for yoga, pilates, ballet, dance, stretching, running, certain types of exercise, and the like, as well as for fashion footwear, slippers, etc.

The article of footwear 100 of FIGS. 1A through 1H includes an upper member 102 engaged with a sole member 104, at least a portion of which is visible when viewing the exterior of the article of footwear 100. The upper member 102 of this example article of footwear 100 is constructed from at least one textile or fabric material that forms the major portion of the exterior surface 102*a* of the upper member 102. As will be described in more detail below, a wide variety of different textile materials may be used as the upper member exterior surface 102*a*, including a wide variety of natural and synthetic materials. In the illustrated example, a single piece of fabric material makes up the major portion of the exterior 102*a* of the upper member 102 (in this example, one piece of material makes up all or substantially all of the exterior 102*a* of the upper member 102).

The interior surface 102*b* of the upper member 102 (e.g., a surface at least partially defining a foot-receiving chamber for the article of footwear 100) may take on a variety of forms without departing from this invention. For example, if desired in accordance with at least some examples of this invention, the interior surface 102*b* may simply constitute the backside of the textile material making up the exterior surface 102*a*. In other example structures, as will be described in more detail in the sections that follow, the interior surface 102*b* of the upper member 102 may be constructed from one or more different pieces of textile material as compared to the textile material(s) making up the exterior surface 102*a* (e.g., such that textile material making up the interior surface 102*b* at least partially overlays and/or lines the exterior surface 102*a* so as to lay between the user's foot and the material making up the exterior surface 102*a* when the article of footwear 100 is in use). A single or multiple pieces of fabric material may be used to make the interior 102*b* of the upper member 102. If desired, the single piece of fabric material may form a major portion of the interior surface 102*b*, and in some examples, one piece of material may make up all or substantially all of the interior 102*b* of the upper member 102. Various example ways of joining textile materials making up the interior surface 102*b* and the exterior surface 102*a* of the upper member 102 in accordance with examples of this invention are described in more detail in the sections that follow. By constructing the interior and exterior of the upper member 102 from fabric or textile materials, the resulting upper structure 102 may be very soft, flexible, and comfortable for the wearer.

As shown in FIGS. 1A through 1E, the exterior surface 102*a* of the upper member 102 includes various regions having different characteristics, structures, or textures. In at least some examples of this invention, and as will be described in more detail in the sections that follow, the exterior surface 102*a* of the upper member 102 may be constructed so as to have independent regions of different structures, textures, or characteristics, even though, in at least some instances, the overall exterior surface 102*a* (or at least some portions of it containing different regions) will be formed from a single, continuous piece of textile material (e.g., the textile material may include different stitching or constructions in certain areas to form the independent regions of different structures, textures, or characteristics). In the example structure 100 illustrated in FIGS. 1A through 1E, the exterior surface 102*a* of the upper member 102 includes independent regions 106 and 108 having a ribbed structure, to provide additional stability and support for the wearer's foot, as well as regions 110 having a non-ribbed structure (e.g., a smooth structure).

Figure 1B:
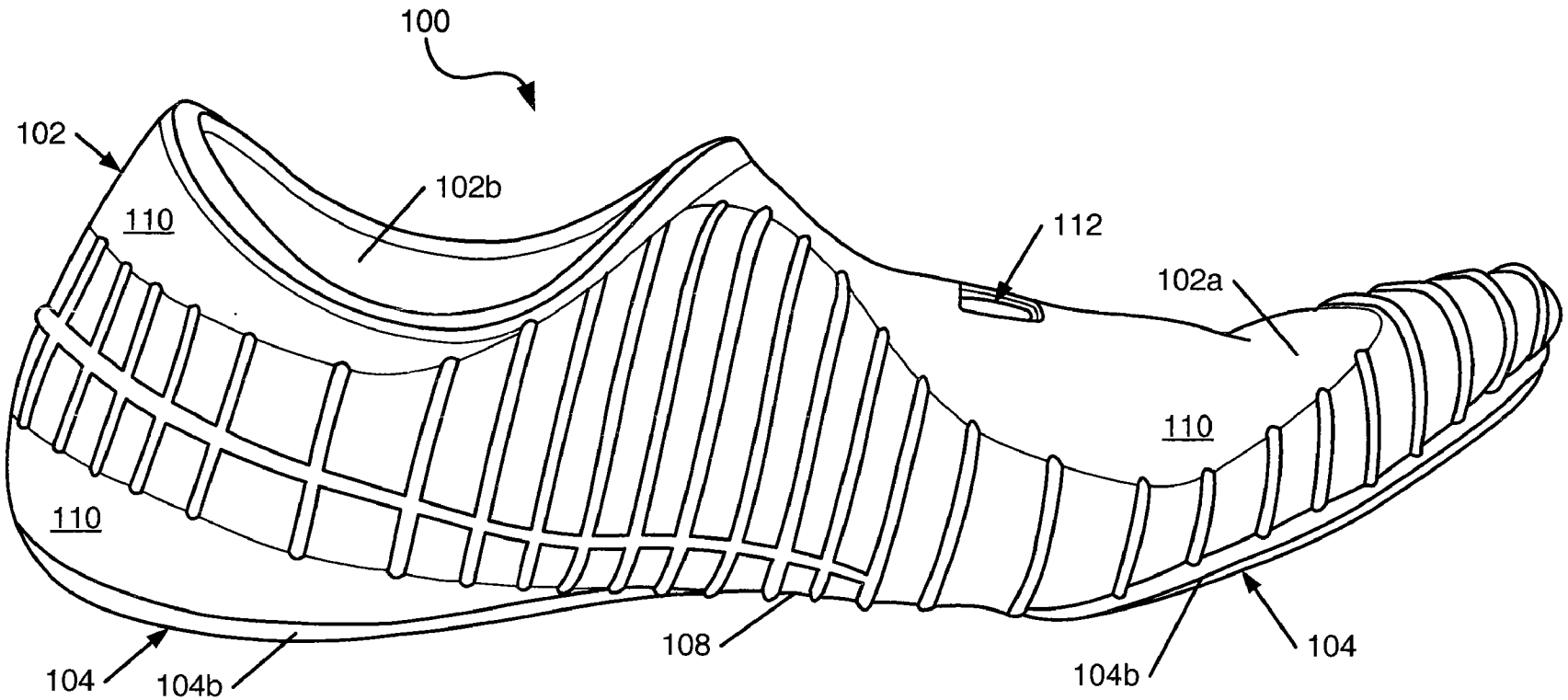

The areas of increased stability (e.g., the ribbed regions 106 and 108 in the example structure 100) may be provided at any desired location without departing from this invention, e.g., at anatomically dictated positions depending on the intended use of the article of footwear 100. As shown in FIGS. 1A through 1E, in this example structure 100, one independent region having an increased stability structure (e.g., ribbed region 106) is located at the lateral midfoot (or arch) region of the article of footwear 100. More specifically, as shown in FIGS. 1A and 1D, the ribbed region 106 of this structure 100 is bordered on its bottom edge by a junction between the upper member 102 and the sole member 104 along the lateral midfoot area, and it is bordered on its side and top edges by the non-ribbed region 110.

Another increased stability area (e.g., ribbed region 108) in this example structure 100 extends across the toe or forefoot portion of the article of footwear 100, as shown in FIGS. 1A through 1D. While this increased stability region 108 could extend to cover only the toe portion, if necessary or desired, as shown in this illustrated example, this ribbed region 108 extends continuously from the forefoot region, along the medial side of the article of footwear 100, through the medial midfoot region, and to the rearfoot or heel area of the article of footwear 100. However, rather than providing a single continuous ribbed region extending essentially the entire length of the medial side of the article of footwear 100, if desired, various independent regions of increased stability may be provided, e.g., by breaking the large region 108 into smaller separate regions, e.g., to cover one or more of the following locations: across the toe area, along the medial midfoot (arch) area, along the medial foot-receiving opening region, and/or along and around the medial rearfoot area, etc.

Of course, not all of the ribbed regions 106 and 108 (or other areas of increased stability) need have the same exact constructions, structures, textures, patterning, or other characteristics. Rather, if desired, different ribbing patterns or structures may be used in the various areas, differences in the ribbing structures and/or patterns may be provided within a given single region (e.g., different rib heights, widths, spacings, etc.), and the like. Additionally, if desired, stability enhancement may be provided in other manners without departing from the invention, for example, by providing thicker or stiffer fabric patterns or structures at some areas as compared to others, by providing two-dimensional or criss-crossed ribbing patterns in some areas as opposed to one dimensional ribbing in other areas, etc.). Also, if desired, and as illustrated in FIGS. 1A and 1B, some stability enhanced regions may have different ribbing structures as compared to other regions on the same article of footwear (e.g., region 106 has one dimensional generally parallel ribs while a portion of region 108 also includes a transverse rib, etc.). Many variations in the stability-enhancing structures for the various regions of an article of footwear are possible without departing from this invention.

The non-stability enhanced regions (e.g., the non-ribbed smooth regions 110 in this example structure 100) may extend continuously in all areas of the footwear structure 100 that do not contain increased stability structures (e.g., around and between all ribbed regions 106 and 108 on the exterior surface 102*a* of the upper member 102). Of course, if desired, various different structures, textures, patterning, and/or other characteristics may be provided in the area(s) that do not contain increased stability structures without departing from this invention. As a more specific example, the area 110 need not be maintained smooth, and all portions of the area 110 need not have exactly the same structures, textures, patterning, or other characteristics. Variations in the area 110 are possible without departing from this invention.

Because the upper member 102 of this example footwear structure 100 may be constructed from sufficiently flexible and stretchable material (e.g., the example materials described in more detail below), conventional laces or other securing mechanisms are not necessary (e.g., the upper member 102 of the article of footwear 100 is sufficiently stretchable and flexible to allow entry of the foot, and the upper member 102 returns toward its original position to a sufficient degree to securely maintain the article of footwear 100 on the user's foot without the need for laces, buckles, or other securing mechanisms). Of course, if desired, additional securing mechanisms may be provided, in accordance with at least some examples of footwear structures according to the invention.

Figure 1C:
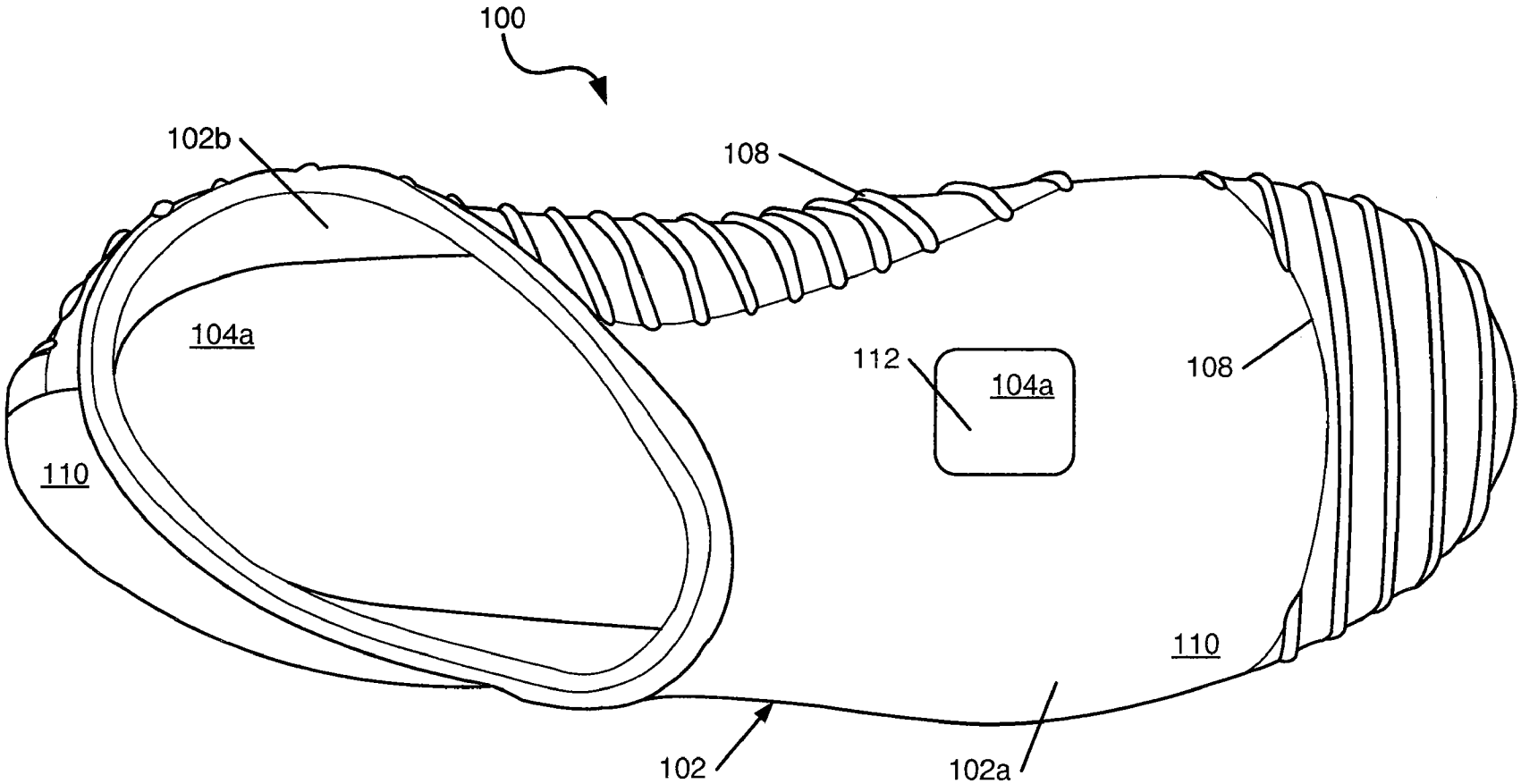
Figure 1D:
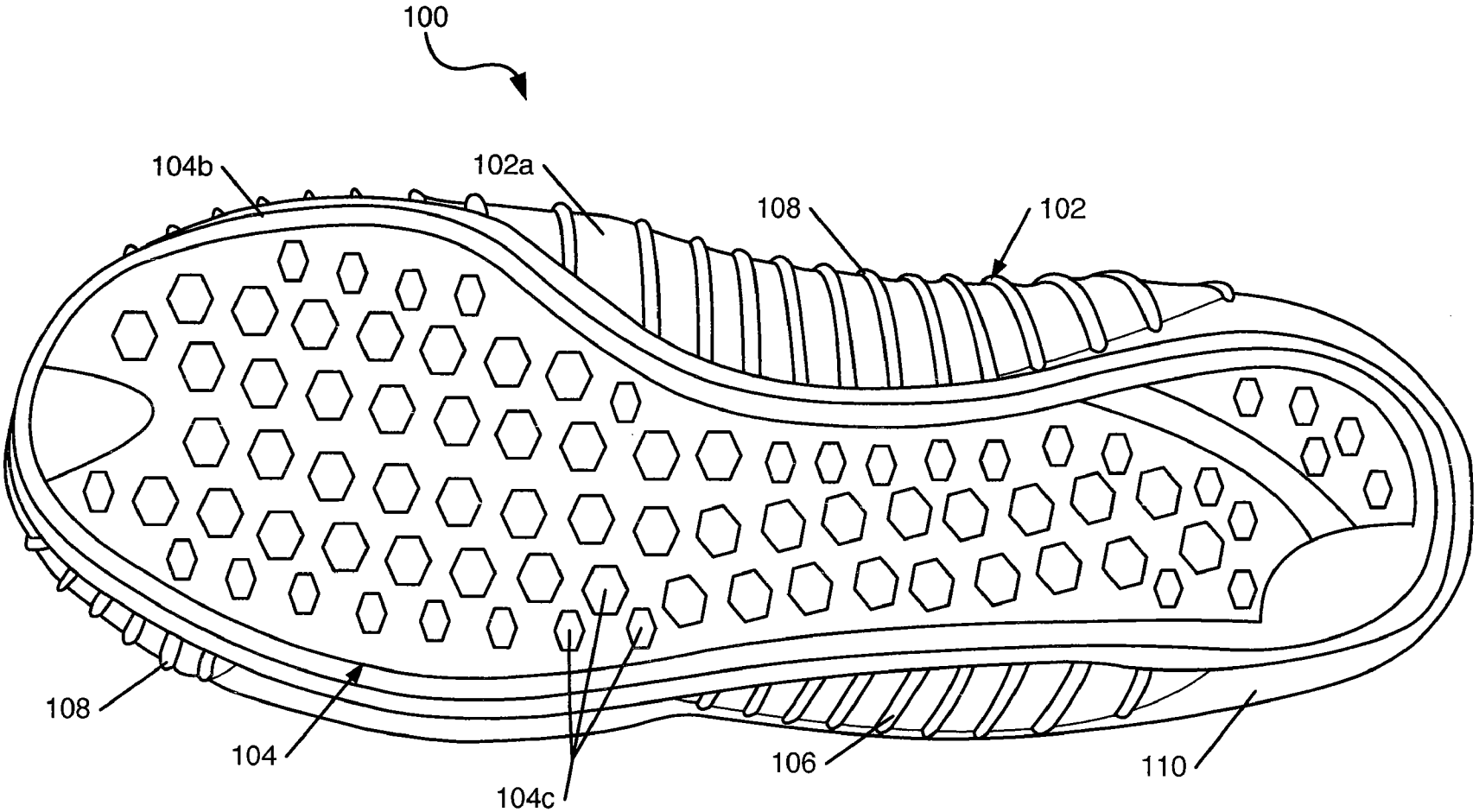
Figure 1E:
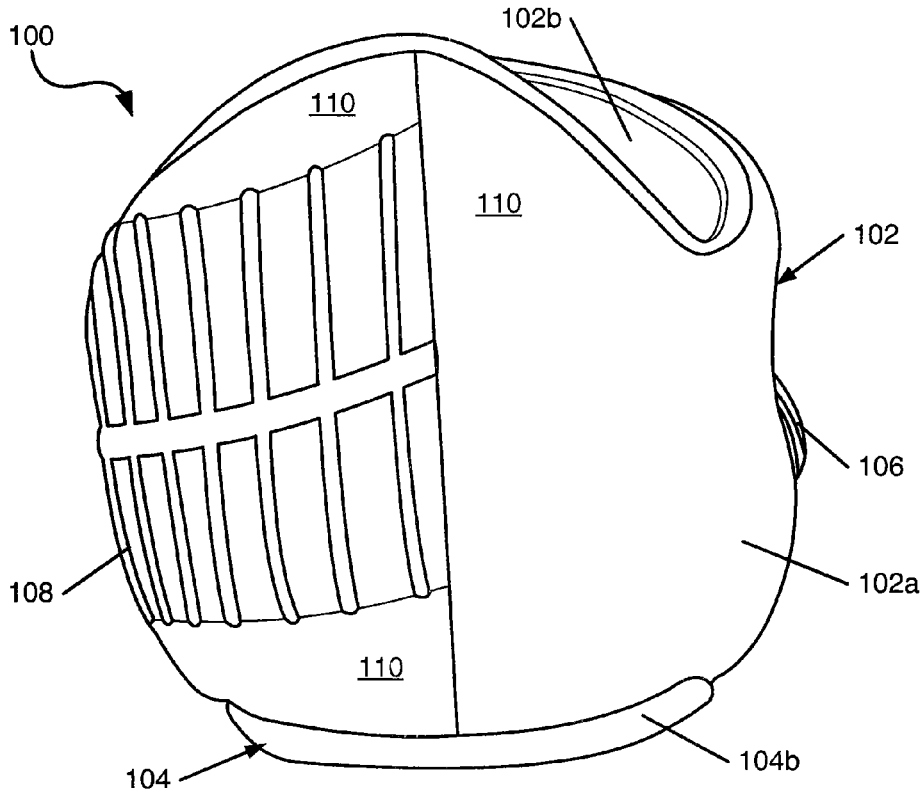

FIGS. 1A through 1C further illustrate that the upper member 102 of this example structure 100 includes an opening 112 defined therein in the instep area of the upper member 102. Of course, any desired number of openings may be provided in the upper member 102, at various different locations, without departing from this invention. In accordance with at least some examples of this invention, the opening(s) 112 may provide various features. For example, the opening(s) 112 may enable the upper member 102 to better flex, stretch, and move with the user's foot, e.g., without excessive bunching, pinching, or the like, for example, when the foot is inserted into the article of footwear 100 and/or when the article of footwear 100 is being used. Additionally, the opening(s) 112 can provide additional ventilation and air exchange to help keep the foot cool, to help the footwear 100 better dry out after use, etc. As still another example, one or more openings 112 may be provided for aesthetic and/or design purposes, to provide an interesting appearance for the article of footwear 100. One or more openings 112 may be provided for other desired purposes and/or at other desired locations as well. If desired, the material at the edges of the opening(s) 112 (e.g., composed of textile materials 102*a* and 102*b* of the upper member 102) may be fixed together in a seamless manner, as will be described in more detail below. Of course, if desired, other fixing methods may be used (such as sewing in stitched seams) in at least some example structures without departing from this invention.

If desired, in order to provide some additional structure and stability to the article of footwear 100 and/or its upper member 102, a heel cup or counter, a toe cup or counter, arch supports, or other support elements may be provided without departing from this invention. Such additional elements, when provided, may be of conventional design and/or construction and/or included as part of the upper member structure and/or the sole structure in a conventional manner. As more specific examples, if desired, a heel counter and/or other support elements may be provided between layers of fabric making up the upper member 102, on the exterior surface 102*a*, on the interior surface 102*b*, etc., without departing from the invention. Also, if desired, these support elements may be made from relatively flexible plastic or other materials, e.g., to maintain a very flexible overall footwear structure 100 when the article of footwear 100 is used for yoga, pilates, dance, ballet, stretching, and the like, as well as for fashion footwear, slippers, etc.

The sole member 104 also may take on various forms and structures without departing from this invention, e.g., to provide a flexible and supporting surface-contacting member useful for yoga, pilates, dance, ballet, stretching, and the like, as well as for fashion footwear, slippers, etc. In this illustrated example structure 100, the sole member 104 includes a comfort enhancing insole element 104*a* included within the foot-receiving chamber of the article of footwear 100 to contact the user's foot in use. The insole member 104*a* may be fixed to a portion of the upper member 102 (e.g., to the interior textile member 102*b* (if any) and/or to the inside of the exterior textile member 102*a* via adhesives, bonding, etc.), or it may be non-fixedly contained within the foot-receiving chamber. Any desired material(s) and/or construction may be used for the insole member 104*a* without departing from this invention, including conventional materials and constructions known and used in the art.

On the exterior of the article of footwear 100, the sole member 104 may include a midsole element 104*b* (e.g., made of a polymeric material as described above) that attenuates impact or ground reaction forces. The midsole element 104*b* (which may constitute one or more independent pieces) may be attached to the upper member 102 in any desired manner, including in conventional manners known and used in the art, such as via adhesives or cements, via stitching, sewing, or other bonding techniques, via mechanical connectors, and the like. Of course, any desired midsole member 104*b* thickness and/or construction may be used without departing from the invention, e.g., keeping in the spirit of the desired purpose of the ultimate article of footwear 100 (e.g., for use in yoga, pilates, dance, ballet, stretching, running, or other purposes, in this illustrated example). Also, if desired, the midsole member 104*b* may be omitted (e.g., if the insole member 104*a* and/or the outsole member(s) 104*c* provide sufficient impact force attenuation for the desired use of the article of footwear 100) without departing from this invention.

The sole member 104 of this example structure 100 also includes outsole member 104*c*, e.g., designed to directly engage the ground or other surface when the article of footwear 100 is used. The outsole member 104*c* (e.g., including multiple individual outsole element(s) 104*c* in this example structure 100) may provide traction and/or wear resistance, and may be made from any desired material, including materials conventionally known and used in the art. If desired, the outsole member 104*c* may constitute a single element that spans a large portion of and/or the entire length and/or width of the footwear bottom structure, or the outsole member 104*c* may be made from multiple elements engaged with the midsole structure 104*b*, such as independent outsole or traction elements 104*c* engaged with the midsole member 104*b* or an outsole base plate structure via adhesives, cements, or other securing systems. Any desired outsole member 104*c* thickness and/or construction may be used without departing from the invention, e.g., keeping in the spirit of the desired purpose of the ultimate article of footwear 100 (e.g., for use in yoga, pilates, dance, ballet, stretching, running, or other purposes, in this illustrated example).

As to the construction of an article of footwear 100, if desired, blanks in a suitable shape for the upper member 102 of the article of footwear 100 may be cut (e.g., for the interior and exterior layers, 102*b* and 102*a*, respectively). These blanks may be joined together, e.g., at the foot-receiving openings and/or along the bottom surface of the upper member 102 along the bottom of the foot location, e.g., via stitching, bonding techniques, etc., to generally form the upper member structure 102. One or more portions of the sole member structure 104 may be engaged with the upper member 102, e.g., by inserting an insole member 104*a* into the foot-receiving chamber, optionally by fixing the insole member 104*a* inside the foot-receiving chamber (e.g., via adhesives, bonding, stitching, etc.), by attaching a midsole member 104*b* and/or an outsole member 104*c* to the exterior bottom of the upper member 102, and/or by attaching one or more outsole elements (or traction elements) to a midsole member 104*b* and/or an outsole member 104*c*. Any construction process may be used without departing from the invention, including one or more conventional footwear construction processes known and used in the art.

FIGS. 2A through 2D illustrate another example article of footwear structure 200 in accordance with at least some examples of this invention. This example article of footwear 200 includes an upper member 202 made from a textile material, which optionally may have an exterior surface 202*a*, at least a major portion of which may be made from a first piece of textile material, and an interior surface 202*b*, at least a major portion of which may be made from a second piece of textile material. The pieces of textile material may be constructed from the same type of material, if desired, and/or these pieces of material 202*a* and 202*b* may have different structures, patterning, constructions, characteristics, or the like, as generally described above. While a wide variety of different textile material constructions and combinations may be used without departing from this invention, in the illustrated example, the exterior surface 202*a* of the upper member 202 has a generally ribbed structure (e.g., to provide support and structure to the upper member) while the interior surface 202*b* is generally smooth (e.g., to provide a comfortable fit). The pieces of material 202*a* and 202*b* may be fit together in various manners, including in conventional manners known and used in the art. Alternatively, if desired, the pieces of material 202*a* and 202*b* may be fit together in a stitchless manner, as will be described in more detail below.

The footwear structure 200 of FIGS. 2A through 2D has a sole structure 204 that is somewhat similar to that described above with respect to FIGS. 1A through 1E in that the sole structure 204 includes an insole member 204*a*, a midsole member 204*b*, and an outsole member 204*c*. In this example structure 200, however, portions of the midsole member 204*b* and/or the outsole member 204*c* extend from the bottom of the article of footwear 200 up and along the rear heel portion of the article of footwear 200, and a different pattern of traction elements 204*d* on the outsole member 204*c* is provided. This midsole and/or outsole construction provides enhance support and stability in the heel area of the article of footwear 200, and also provides an interesting aesthetic appearance (e.g., by making the parts of various different colors). Of course, a wide variety of sole member designs, constructions, tread designs, and aesthetic appearances may be provided without departing from this invention.

As additional alternatives, if desired, the midsole member 204*b* may be completely covered by the outsole member 204*c*, at least partially included within the foot-receiving chamber (e.g., along with and/or as part of the insole member 204*a*), and/or completely omitted from the footwear structure without departing from this invention.

This example footwear structure 200 includes plural openings 212 in the instep area, e.g., for the various example and potential purposes described above with respect to opening(s) 112 in FIGS. 1A through 1C. If desired, the material at the edges of these openings 212 (e.g., composed of textile materials 202*a* and 202*b* of the upper member 202) may be fixed together in a seamless manner, as will be described in more detail below. The edges may be formed in various manners, such as scalloped, pinked, straight, etc., including various manners that may not be possible or practical with conventional cut and sew techniques. Of course, if desired, other fixing methods may be used (such as sewn seams) in at least some example structures without departing from this invention.

Given the above descriptions of the structures of various example articles of footwear in accordance with this invention and certain example variations on these structures, additional specific features of example structures, materials, and methods in accordance with at least some examples of this invention are described below. While the description below generally is directed to the example structure of the invention illustrated in FIGS. 1A through 1H, those skilled in the art will recognize, of course, that various features of this more specific description can be extended to a wide variety of other example structures, including the example of FIG. 2, without departing from the invention.

B. Upper Member Constructions and Materials in Accordance with Some Examples of this Invention Various materials may be utilized in manufacturing the upper member 102 without departing from this invention. In at least some examples, the upper member 102 of the article of footwear 100 may be formed from multiple material layers that include an exterior textile layer 102*a*, optionally an intermediate layer, and an interior textile layer 102*b*. The materials forming the exterior layer 102*a* of the upper member 102 may be selected to exhibit various desired properties, for example, based upon a desired level of wear-resistance, flexibility, stability, air-permeability, support, and the like. With regard to the exterior layer 102*a*, as described above, the toe area, the heel area, the entire medial side, and/or the arch or midfoot areas of both sides of the article of footwear 100 may be constructed to have higher stability and/or provide a greater degree of support as compared to other areas, e.g., when the article of footwear 100 is used for dance, yoga, pilates, ballet, stretching, running, or other purposes, as well as for fashion footwear, slippers, etc.

In accordance with at least some examples of this invention (and as described above), the exterior layer 102*a* of the upper member 102 may be formed from one or more synthetic or natural textile materials. In at least some examples, the exterior layer 102*a* of the upper member 102 may be formed from plural material constructions or formations that each impart different properties or characteristics to specific portions of the upper member 102 (e.g., ribbed or other support or stability structures in some areas to provide higher stability as compared to other (e.g., non-ribbed) areas, etc.).

An intermediate layer of the upper member 102 (not shown in the figures), when present, may be formed from a lightweight polymer foam material, e.g., to provide comfort and impact-attenuation and/or to protect the foot from objects that may contact the upper member 102. An interior-most layer 102*b* of the upper member 102 may be formed, for example, from a moisture-wicking textile material that removes perspiration from the area immediately surrounding the foot. Although any methods may be used, in some articles of footwear 100 according to examples of the invention, the various layers or textile materials making up the upper member 102 may be joined to one another, in at least some areas, with an adhesive in a stitchless manner, as will be described in more detail below. Alternatively, as another example, if desired, in accordance with at least some example structures, stitching may be utilized to join elements within a single layer and/or to reinforce, stabilize, or support specific areas of the upper member 102.

Although the materials selected for the upper member 102 may vary widely, textile materials often form at least a portion of the exterior layer 102*a* and interior layer 102*b*, and in many instances major portions of these layers. A "textile" may be defined as any material manufactured from fibers, filaments, or yarns characterized by flexibility, fineness, and a high ratio of length to thickness. Textiles generally fall into two categories. The first category includes textiles produced directly from webs of filaments or fibers by randomly interlocking to construct non-woven fabrics and felts. The second category includes textiles formed through a mechanical manipulation of yarn, thereby producing a woven fabric, a knitted fabric, etc.

Yarn is a raw material utilized to form textiles in the second category. In general, "yarn" is defined as an assembly having a substantial length and relatively small cross-section that is formed of at least one filament or a plurality of fibers or filaments. Fibers have a relatively short length and require spinning or twisting processes to produce a yarn of suitable length for use in textiles. Common examples of fibers are cotton and wool. Filaments, however, have an indefinite length and may merely be combined with other filaments to produce a yarn suitable for use in textiles. Modem filaments include a plurality of synthetic materials such as rayon, nylon, polyester, and polyacrylic, with silk being the primary, naturally-occurring exception. Yarn may be formed of a single filament, which is conventionally referred to as a "monofilament yarn," or a plurality of individual filaments grouped together. Yarn also may include separate filaments formed of different materials, or the yarn may include filaments that are each formed of two or more different materials. Similar concepts also apply to yarns formed from fibers. Accordingly, yarns may have a variety of configurations that generally conform to the definition provided above.

Various techniques exist for mechanically manipulating yarn into a textile. Such techniques include, for example, interweaving, intertwining and twisting, and interlooping. Interweaving is the intersection of two yarns that cross and interweave at right angles to each other. The yarns utilized in interweaving are conventionally referred to as "warp" and "weft." Intertwining and twisting encompasses various procedures, such as braiding and knotting, where yarns intertwine with each other to form a textile. Interlooping involves the formation of a plurality of columns of intermeshed loops, with knitting being the most common method of interlooping.

The textiles utilized in footwear upper members 102 in accordance with at least some examples of this invention generally provide a lightweight, air-permeable structure that is highly flexible and comfortably receives the foot. In order to impart other properties to the footwear 100, including durability, stability, flexibility, and stretch-resistance, additional materials may be combined with the textile, including, for example, leather, synthetic leather, or rubber. With regard to durability, U.S. Pat. No. 4,447,967 to Zaino discloses an upper member formed of a textile material that has a polymer material injected into specific zones to reinforce the zones against abrasion or other forms of wear. Regarding stretch resistance, U.S. Pat. Nos. 4,813,158 to Brown and 4,756,098 to Boggia both disclose a substantially inextensible material that is secured to the upper, thereby limiting the degree of stretch in specific portions of the upper member. These three patent documents are entirely incorporated herein by reference.

In accordance with at least some examples of the present invention, the upper member 102 for an article of footwear 100 may include one or more textile elements formed with a knitting machine (e.g., into "blanks"). The textile elements may have edges that are joined together to define at least a portion a foot-receiving chamber for the article of footwear 100, as described above. In accordance with at least some example aspects of the invention, the textile element(s) forming at least a portion of the exterior surface 102*a* of the upper member 102 may have a first area and a second area of unitary construction. The first area may be formed of a first stitch configuration, and the second area may be formed of a second stitch configuration that is different from the first stitch configuration to impart varying textures, structures, patterning, and/or other characteristics to the upper member 102 (e.g., to a surface of the textile element making up the exterior surface 102*a* of the upper member 102). The knitting machine used to make the textile element of the exterior surface 102*a* may have a configuration that forms the textile element through either warp knitting or weft knitting.

In accordance with at least some example aspects of the invention, a method of manufacturing an article of footwear 100 may include a step of mechanically-manipulating a yarn with a circular knitting machine, for example, to form a cylindrical textile structure. In addition, the method may involve removing at least one textile element from the textile structure (e.g., cutting out the textile "blank"), and incorporating the textile element into an upper member 102 of the article of footwear 100.

The textile element forming at least a portion of the exterior surface or layer 102*a* of an upper member 102 of an article of footwear 100 may be primarily formed from one or more yarns that are mechanically-manipulated, for example, through interweaving, intertwining and twisting, and/or interlooping processes, as mentioned above. A variety of mechanical processes have been developed to manufacture textiles. In general, the mechanical processes may be classified as either warp knitting or weft knitting. With regard to warp knitting, various specific sub-types that may be utilized to manufacture textile materials include tricot, raschel, and double needle-bar raschel (which further include jacquard double needle-bar raschel). With regard to weft knitting, various specific sub-types that may be utilized to manufacture textile materials include circular knitting and flat knitting. Various types of circular knitting include sock knitting (narrow tube), body garment (seamless or wide tube), and jacquard.

The textile elements for the upper member 102, including the exterior layer 102*a* thereof, may be formed through any of the mechanical processes discussed above, e.g., on a conventional warp knitting machine or a weft knitting machine. One suitable knitting machine for forming a textile element for use in accordance with this invention is a wide-tube circular knit jacquard machine. Another suitable knitting machine for forming a textile element for use in accordance with this invention is a wide-tube circular knitting machine that is produced in the Lonati Group by Santoni S.p.A. of Italy under the SM8 TOP1 model number. This Santoni S.p.A. wide-tube circular knitting machine may form a textile structure having a diameter that ranges from 10 inches to 20 inches, with 8 feeds for each diameter. The machine exhibits a maximum 140 revolutions per minute for 10 inch diameters, and a maximum 120 revolutions per minute for 13 inch diameters. Furthermore, the machine gauge is variable between 16, 22, 24, 26, 28, and 32 needles per inch, and is suitable for various needle gauges ranging from 48 to 75.

A wide-tube circular knitting machine, e.g., as produced by Santoni S.p.A., forms a generally cylindrical textile structure and is capable of forming various types of stitches within a single textile structure. In general, the wide-tube circular knitting machine may be programmed to alter the design on the textile structure through needle selection. That is, the type of stitch that is formed at each location or region on the textile structure may be selected by programming the wide-tube circular knitting machine such that specific needles either accept or do not accept yarn at each stitch location. In this manner, various patterns, textures, structures, or designs may be selectively and purposefully imparted to the textile structure at various different locations. For example, ribbed areas or regions may be defined at various locations in the textile material (e.g., at appropriate locations in the blank structure) used to make the exterior surface 102*a* of the upper member 102. Once the various portions of the textile material have been produced, the textile materials for the exterior and/or interior surfaces of the upper member 102 may be cut (e.g., using die-cutting, laser-cutting, or other conventional cutting operations) to form the material blank(s) used to make the upper member 102.

In order to provide adequate stretch and recovery properties for an upper member 102 for at least some uses, and particularly to the textile element making up the exterior surface 102*a* of the upper member 102, a yarn that incorporates an elastane fiber may be utilized. Elastane fibers, such as spandex type fibers, are available from E.I. duPont de Nemours Company under the trademark LYCRA®. Such fibers may have the configuration of covered LYCRA®, wherein the fiber includes a LYCRA® core that is surrounded by a nylon sheath. One example yarn material that may be used in accordance with at least some example of this invention includes a 70 denier elastane core that is covered with nylon having a 2 ply, 80 denier, 92 filament structure. Of course, a wide variety of other fibers or filaments exhibiting elastic properties may also be utilized without departing from this invention.

As discussed above, a yarn that incorporates elastane fibers may be suitable for at least some of the various textile elements of the upper member 102. A plurality of other yarns, whether elastic or inelastic, also may be used without departing from this invention. The characteristics of the yarn selected for the various portions of the upper member 102 depend primarily upon the materials that form the various filaments and fibers. Cotton, for example, provides a soft hand, natural aesthetics, and biodegradability. Elastane fibers, as discussed above, provide substantial stretch and recoverability. Rayon provides high luster and moisture absorption. Wool also provides high moisture absorption, in addition to insulating properties. Polytetrafluoroethylene coatings may provide a low friction contact between the textile and the skin. Nylon is a durable and abrasion-resistant material with high strength. Finally, polyester is a hydrophobic material that also provides relatively high durability. Accordingly, the materials comprising the yarn may be selected to impart a variety of physical properties to textile elements making up the upper member, and the physical properties may include, for example, strength, stretch, support, stiffness, recovery, fit, and form.

As shown in FIGS. 1A through 1F, areas of the textile element making up the exterior surface 102*a* of the upper member 102 may include various different regions, e.g., regions having different stitching patterns (e.g., first regions, with a ribbed stitching pattern 106 and/or 108, and second regions 110, with a generally smooth and non-varied stitch configuration). A wide-tube circular knitting machine is generally capable of forming various types of stitches within a single textile structure to enable formation of these various stitching patterns in a textile element. The wide-tube circular knitting machine may, therefore, vary the stitches within the textile element to produce the various desired patterns, designs, structures, or textures in a single, continuous piece of textile material. Various types of stitching patterns also may be formed with other types of knitting machines or other machines, optionally on a single, continuous piece of textile material, without departing from the invention. As shown in FIGS. 1A through 1C, a textile element for the exterior surface 102*a* of the upper member 102 may be formed with a central area that corresponds with the instep region of the article of footwear 100 that is generally smooth, while other portions of the same textile element are formed with the ribbed structures (e.g., plural longitudinal ribs at the desired locations, extending in the desired directions, as shown in regions 106 and 108 in FIGS. 1A through 1E, to provide stability). When incorporated into footwear, the ribs may be provided to extend generally up, down, and/or around the foot, although transverse, criss-crossing, or other rib arrangements also may be provided, if desired. In addition to affecting the stability of the upper member 102, at least some ribs may be present for aesthetic purposes, they may affect the stretch and/or return properties of upper member 102, and the like.

Figure 1F:
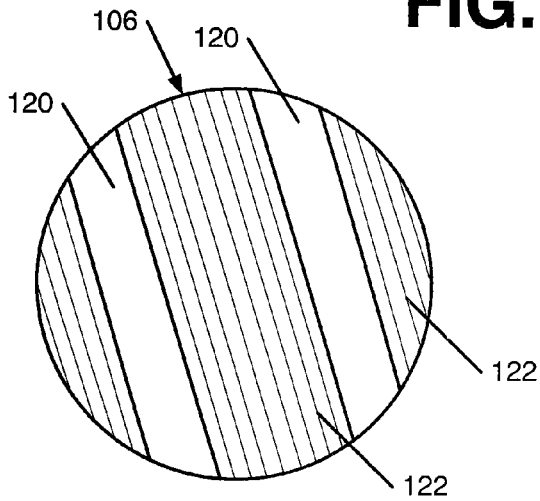

FIG. 1F provides an enlarged view of a ribbed region (e.g., regions 106 and/or 108), as shown in FIG. 1A. As shown, the ribbed regions may include enlarged rib elements 120 formed by the knitting process (e.g., for stability purposes). Gathered material areas 122 (also formed in the knitting process in this example structure) between the enlarged ribs 120 provide, for example, additional material for flexibility, stretchability, and material return purposes, as well as stability. Of course, as noted above, a wide variety of ribbing patterns, patterns between adjacent ribs, and/or other supporting structures may be provided without departing from this invention.

Many conventional articles of footwear incorporate upper members with various different and independent material elements that each exhibit different properties. For example, a first material element may be smooth, and a second material element may be textured. The first and second material elements then are stitched together to form a portion of the conventional upper member. In contrast with the conventional uppers, however, different textured regions may be provided in accordance with at least some examples of this invention as a single, unitary element of textile, rather than as two separate elements that are stitched or otherwise joined together. Elimination of the stitching can be useful, for example, to eliminate potential areas of abrasion or other discomfort, to eliminate the aesthetically displeasing seam structure, and the like.

Of course, upper members 102 in accordance with at least some examples of this invention are not limited to areas or regions having only two different types of stitching, textures, or other configurations. Any number of different regions and different types of stitching, textures or other configurations may be provided in an individual upper member (e.g., in at least an exterior surface thereof) without departing from this invention. As examples, one or more of the following types of different stitching, patterns, textures, or characteristics may be provided in a textile element by changing the stitching characteristics in an area of the textile material making up the upper member structure 102: smooth areas, roughened areas, areas having different stability characteristics, areas having different stretch characteristics, areas having different air-permeability characteristics, areas with apertures formed therein (e.g., apertures may be formed by omitting stitches at specific locations during the wide-tube circular knitting process, and the apertures may facilitate the transfer of air between the foot-receiving chamber and the area outside of upper member), patterned areas, etc. Accordingly, the various stitches formed in textile elements (e.g., the textile element(s) forming the exterior surface 102*a* of the upper member 102) may be utilized to vary the texture, physical properties, or aesthetics of footwear 100 within a single, unitary element or piece of material.

In addition to varying the stitch types to form textures and the like, the type of yarn utilized in various areas of the textile element(s) making up the various portions of the upper member 102 may be changed to impart different properties. As discussed above, yarn may be formed, for example, from cotton, wool, elastane, rayon, nylon, polyester, etc. Each of these yarn types may impart different properties to the areas of the upper member 102 at which they are located. For example, elastane may be utilized to impart stretch, wool may be utilized for insulation, and nylon may be utilized for durability. The types of knitting used at various different and independent regions of the upper member 102 also may be varied to change the structures and/or properties of a given region as compared to other regions. For example, warp knitting processes may be used in some areas and weft knitting processes may be used in others (e.g., varying between tricot, raschel, double needle-bar raschel, circular knitting, flat knitting, etc.) to provide the regions of different properties (e.g., different stability, wear resistance, air permeability, etc.). Various features, such as a yarn's fiber content, the fabric's construction, the fabric's structure, the fabric's finish, and the like, may be used or changed to alter a fabric's appearance, without departing from this invention.

As mentioned above, a variety of knitting processes may be utilized to form textile element for the upper members 102, as discussed above. As additional more specific examples, a jacquard double needle-bar raschel knitting machine may be utilized to form a flat textile structure. This type of machine also may be utilized to form the textile structure to have the configuration of a spacer mesh textile. Unlike textile structures formed on a circular knitting machine, which exhibit a generally cylindrical configuration, textile structures formed with the jacquard double needle-bar raschel knitting machine typically will have a flat configuration. Like the textile structures described above, however, desired patterns of regions of different stitching may be provided in a textile element formed with the jacquard double needle-bar raschel knitting machine. Even more specifically, the jacquard double needle-bar raschel knitting machine may be utilized to impart various textures, different properties, different patterns, and/or different yarn types to the textile element. Similarly, other types of knitting, such as flat knitting techniques, may be utilized within the scope of the present invention to impart various textures, different properties, different patterns, and/or different yarn types to the textile element.

C. Seam Formation in Accordance with Some Examples of this Invention

Any method or system may be used for joining the various independent textile elements of the upper member 102 together (if any) without departing from the invention, including conventional methods and systems known and used in the art. Conventionally, textile elements may be joined to one another through stitching, which include the interweaving of a yarn through two or more textile elements to secure the textile elements together. Although stitching may be accomplished by hand, this is recognized as a labor-intensive and inefficient process, and sewing machines generally are utilized to stitch textile elements together, thereby forming a seam between the textile elements.

While stitching is the most prevalent method of joining textile elements in modern industry, the process of stitching and the resulting stitched area are subject to certain limitations. For example, sewing machines generally are configured to form a linear or gradually curving seam, rather than highly-curved or angular seams, thereby limiting the configuration of the resulting product. In addition, the edges of textile elements may unravel if not properly surged, hemmed, or turned during the stitching process, which adds technical difficulty to the stitching process and may result in defective articles if not properly executed. Furthermore, many seams may include three or more layers of textile, e.g., due to hemming or turning of the textile elements and/or the number of individual pieces involved, which increase the thickness of the seam and may represent areas of discomfort in the article (e.g., if the thick seam is pressed against the user's body when wearing the article of apparel, if it inhibits air transfer, etc.).

As an alternative to stitching the edges of textile elements together, Bemis Associates, Inc. of Shirley, Mass., United States manufactures polymer heat seal seam tapes that may be utilized, for example, to reinforce seams, replace stitching, bond labels and embroidery to garments, and prevent fraying. The seam tapes are thermoplastic polymers that may be applied by commercially-available taping machines and join textile elements formed of a variety of materials, such as polyester, cotton, and blended fabrics that include both polyester and cotton fibers. More detailed examples of use of these materials as they may be applied to aspects of the present invention are described below.

As described above, the textile elements making up the interior surface 102*b* and the exterior surface 102*a* of upper member 102 in accordance with at least some examples of this invention may be of any manufacture or structure, such as from fibers, filaments, or yarns, whether natural or synthetic. In accordance with at least some examples of this invention, the textile material making the upper member's interior structure 102*b* will differ in some manner from the textile material making up the exterior structure 102*a* (e.g., different materials, different fibers, different knitting or other construction parameters, different surface textures or constructions, etc.). Additionally or alternatively, if desired, the textile materials making up the interior and exterior surfaces (102*b* and 102*a*, respectively) of the upper member 102 may display various different properties or characteristics, such as different thicknesses, different degrees of abrasion resistance, different degrees of air-permeability, different colors, different stabilities, etc.

Adhesive material, like thermoplastic materials available from Bemis Associates, may be used in constructing the upper member 102 in accordance with at least some examples of this invention (e.g., to bind the interior and exterior layers, 102*b* and 102*a*, respectively, together). The adhesive material used to bind the two textile materials together according to at least some examples of this invention may be made from any suitable or desired materials without departing from this invention. As some more specific examples, the adhesive material may be a thermoplastic polymer that forms bonds with the textile element of the upper member exterior 102*a* and the textile element of the upper member interior 102*b*, e.g., when exposed to sufficient heat and pressure, to thereby join the textile elements 102*a* and 102*b* together. Alternatively or additionally, the adhesive material may be a material that forms the bonds with the textile materials through other procedures, such as radio frequency or ultrasonic bonding processes. With regard to the use of thermoplastic polymers, the amount of heat and pressure applied to form the bonds may depend upon the specific material forming the adhesive element, which may be a polyurethane, polyamide, polyester, polyolefin, vinyl, or the like. In general, the application of heat and pressure induces the adhesive material to soften or melt so as to infiltrate the fabric structure of the textile elements. Upon subsequent cooling, the adhesive element becomes securely bonded to each of textile elements, thereby holding the elements together and making up the upper member 102.

A further consideration regarding the adhesive element relates to the manner in which the adhesive element is bonded with the various textile elements. In general, as noted above, heat and pressure may be applied to form the bond. If the adhesive element constitutes a thermoplastic polymer material and it is applied in a two step procedure (e.g., first applied to one textile material (e.g., material 102*a*) and later applied to the other (e.g., material 102*b*) to bind the two textile materials together), a portion of the polymer may bond with or otherwise engage the structure that applies the heat and pressure. In order to alleviate this possibility, a carrier sheet may be applied to one surface of the adhesive element (e.g., the carrier sheet may be paper, a polymer having a higher melting temperature, or any other material that would effectively prevent molten portions of the adhesive element from engaging the structure that applies the heat and pressure). Then, after the adhesive material is attached to the first textile material (e.g., material 102*a*), the carrier sheet may be removed, and the adhesive material (with the first textile material attached thereto) then may be applied to the second textile material (e.g., material 102*b*), e.g., by again applying heat and/or pressure, if necessary, or in any other suitable or desired manner, if necessary. In this manner, the adhesive material surface that will contact the second textile material will not have been affected by the application of the adhesive material to the first textile material.

Articles including seams of the types described above (e.g., stitchless seams) have some potential advantages over articles formed through conventional sewing techniques. As mentioned above, sewing machines generally are configured to form a linear or gradually curving seam, rather than highly-curved or angular seams, thereby limiting the configuration of the resulting product. Articles including adhesive element based seams, on the other hand, may have any desired shapes, including irregular, non-linear shapes, sharp angles, small-radius curves, scalloped edges, pinked edges, or other complex features.

Also, with conventionally sewn seams, the edges of the textile elements may unravel if not properly surged, hemmed, or turned during the stitching process, as mentioned above. The various edges of the textile elements in footwear products including stitchless seams in accordance with at least some examples of the invention, on the other hand, need not be surged, hemmed, or turned to prevent unraveling or fraying. Instead, the adhesive element will infiltrate the structures of the textile elements adjacent to the edges of the textile elements and bind the relative positions of the various fibers, filaments, or yarns. Accordingly, the adhesive element in at least some examples of this invention may serve the dual purpose of joining the edges of the textile elements together and preventing unraveling and fraying of these textile element edges.

As another potential advantage, seams formed through conventional sewing techniques often include multiple layers of textile, e.g., due to hemming or turning of the textile elements, which increases the thickness of the seams. This increased thickness may represent areas of discomfort in the article (e.g., due to pressure, lack of air permeability, etc.). In contrast, articles with bonded seams in accordance with at least some examples of this invention may be constructed to have a reduced thickness as compared with sewn seams. Depending upon the degree of heat and pressure applied in forming the bonds with the adhesive element, the adhesive layer may result in a negligible (and substantially unnoticeable) increase in the thickness of the interface between the textile elements making up the upper member. This stitchless seam also may have improved air-permeability and breathability as compared with the enlarged, thick, sewn seams described above (or optionally, may be further treated to improve its air-permeability, e.g., by making it a more porous structure, using laser treatments, mechanical perforation treatments, etc.).

The degree of heat utilized to melt the adhesive element is primarily dependent upon the materials forming the various textile elements and/or the adhesive element. As an initial consideration, the degree of heat should not melt or otherwise damage the various textile elements prior to the melting of the adhesive element, unless such melting of one or more of the textile elements is intended for forming the bond. This consideration aside, however, the degree of heat and pressure, as well as other potential bonding conditions, will generally relate to the specific material forming the adhesive element. For example, a temperature of 350° F. and a pressure of 40 psi applied for 15 seconds will generally be sufficient to form a bond when the adhesive element is a commercially available polyurethane material. As another example, a temperature between 325 and 375° F. and a pressure between 60 and 80 psi applied for a time between 10 and 15 seconds is generally sufficient to form a bond when the adhesive element is a vinyl or polyamide material.

Figure 1G:
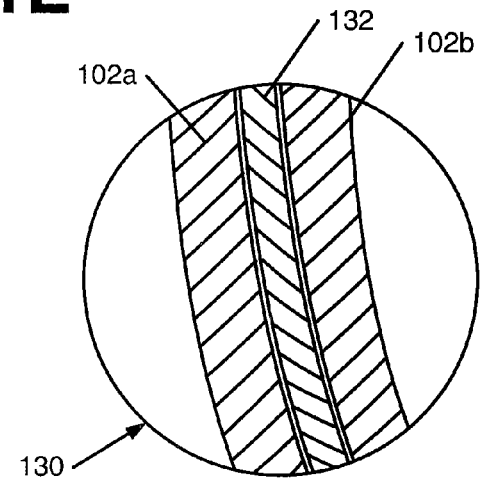
Figure 1H:
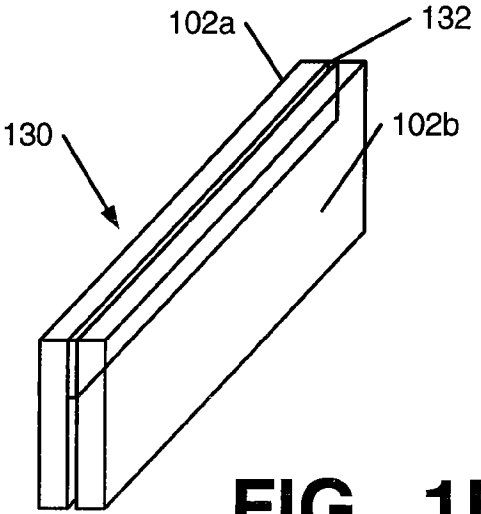

FIGS. 1G and 1H illustrate examples of a stitchless junction or seam 130 that may be formed in accordance with at least some examples of this invention, e.g., around the foot-receiving opening of an article of footwear 100 (e.g., where the interior material 102*b* of the upper member 102 joins the exterior material 102*a*), around openings provided in the instep or other locations, etc. As shown in FIGS. 1G and 1H, the seam 130 may be produced by providing an adhesive layer 132, as described above, between the two layers of textile material 102*a* and 102*b* to be joined together (e.g., in a sandwiched or overlapping structure, as shown in the figures). The adhesive layer 132 may be relatively thin and/or narrow as compared to the other materials 102*a* and/or 102*b*, located at the area generally corresponding to the seam (if desired, the adhesive layer 132 may include some initial tackiness properties under ambient conditions to enable reliable initial placement of the adhesive layer 132 with respect to one or more of the material layers 102*a* and 102*b*). Heat and pressure may be applied to the sandwiched structure (e.g., in a mold or other suitable clamping mechanism) to press or induce migration of the adhesive material from the adhesive layer into the material layers 102*a* and 102*b*, thereby fixing these layers together in a stitchless manner. In this manner, particularly if very thin adhesive layers 132 are provided, the overall seam 130 may have essentially the same dimensions as the combined thicknesses of the two layers of fabric material 102*a* and 102*b*. In at least some procedures, if desired, substantially equal amounts of adhesive material will migrate into each of the fabric material layers 102*a* and 102*b*, although this is not a requirement. As noted above, if desired, additional treatments or process steps may be included, e.g., to further improve air-permeability of the seam 130, etc.

If desired, both layers of textile material 102*a* and 102*b* can be bonded simultaneously to the adhesive layer 132, as described above. Alternatively, a two step bonding process may be utilized, if desired (and as generally described above), in which the adhesive layer 132 is first bonded to one textile layer (e.g., layer 102*a*), for example, by application of heat and/or pressure or other curing conditions, contact paper or other protecting material (if any) is removed from the exposed side of the adhesive layer 132, and the adhesive layer 132 is then bonded to the other textile layer (e.g., layer 102b), for example, by application of heat and/or pressure or other curing conditions.

Figure 3:
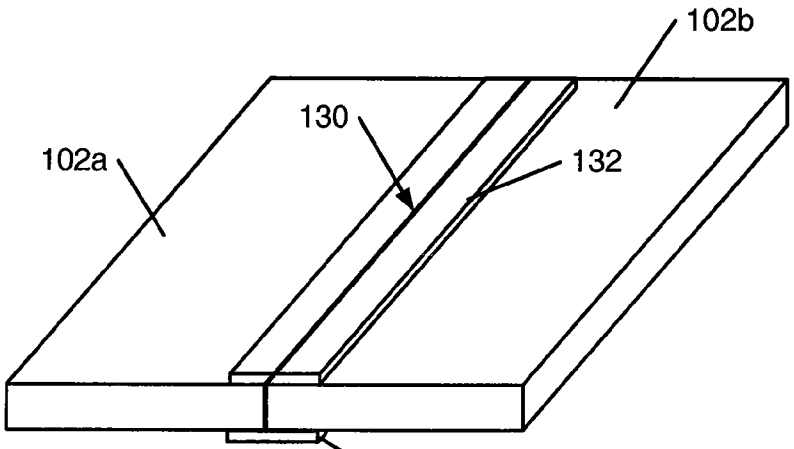
FIG. 3 illustrates an example stitchless seam feature that may be used in accordance with at least some examples of this invention.

In addition to or rather than overlapping or sandwiched type seams of the types described above, one or more layers of adhesive material 132 in accordance with at least some examples of this invention may be used to join adjacent edges of textile material 102*a* and 102*b* to one another in a stitchless manner as illustrated in FIG. 3 (e.g., in a "butt joint" manner). Once the various pieces of material 102*a* and 102*b* and the adhesive material layer(s) 132 are in place, heat and/or pressure (and/or other curing conditions) may be applied to the assembly, e.g., in a one or multi-step process, to produce the final seam joint 130. Of course, other ways of stitchlessly joining two textile materials together to form a seam may be used without departing from this invention. Moreover, if desired, the adhesive material 132 may be applied in multiple separate pieces to the various textile materials 102*a* and/or 102*b*, and, in some instances, it need not be applied along the entire length of the seam.

Figure 4:
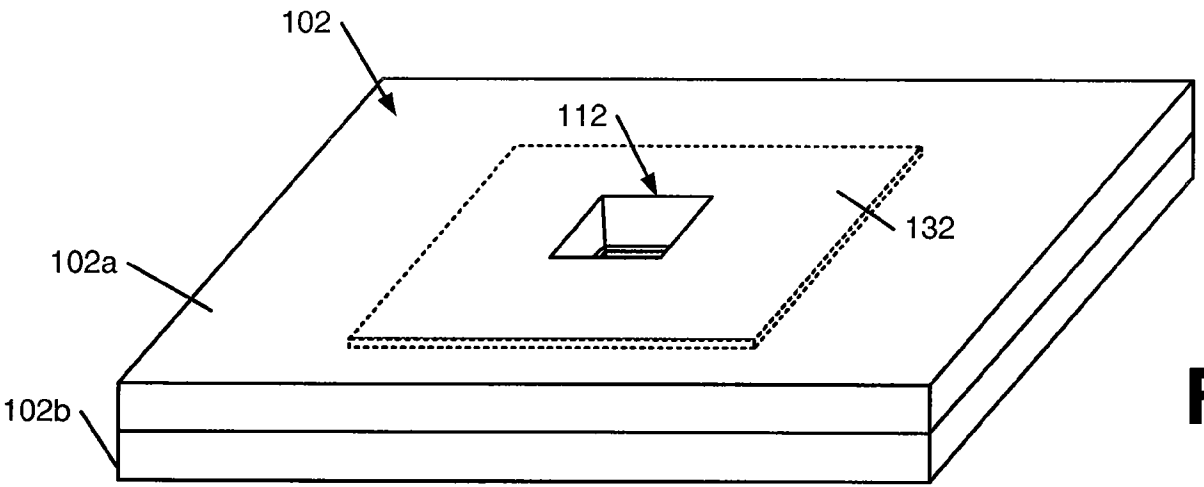
FIG. 4 illustrates an example of stitchless opening formation that may be used in accordance with at least some examples of this invention.
Figure 2A:
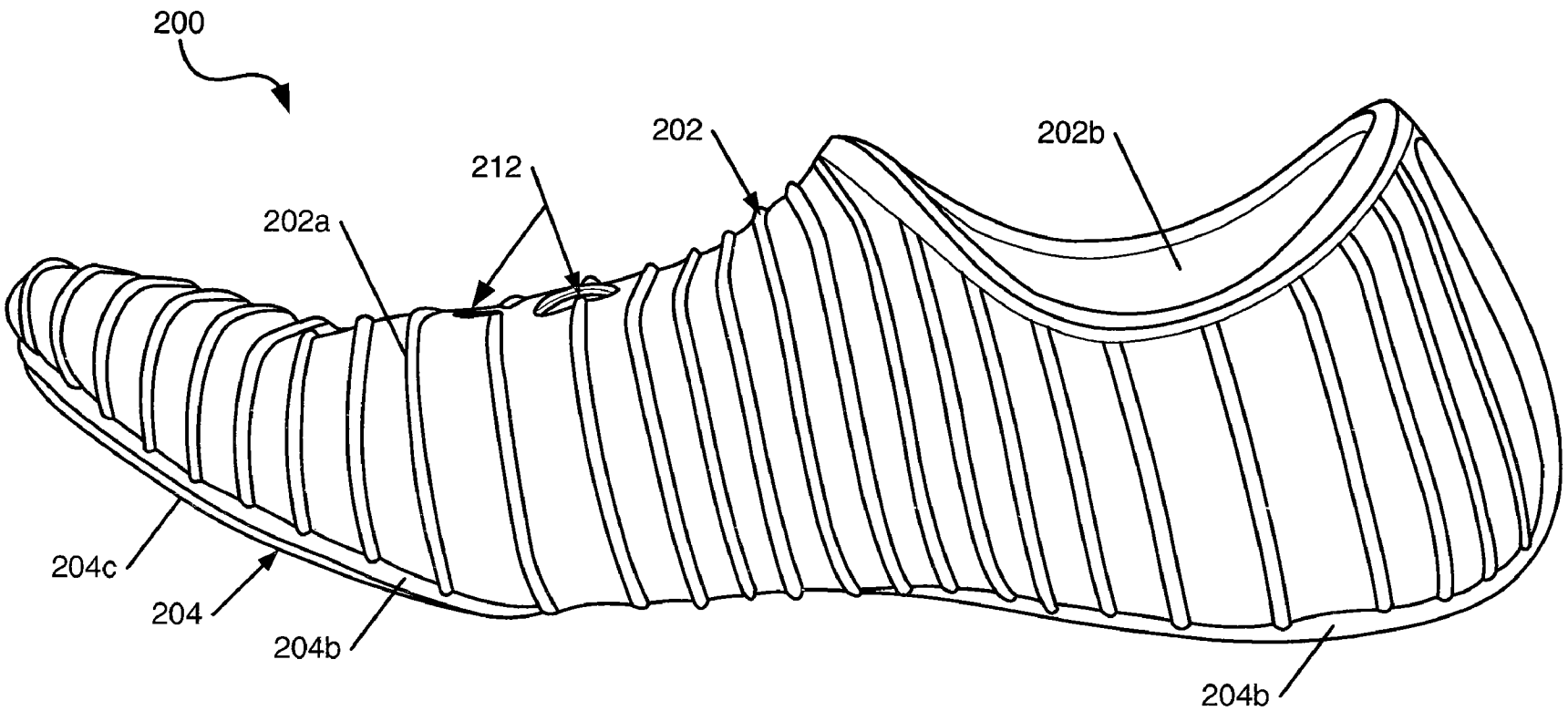
FIGS. 2A through 2D illustrate various views of an example article of footwear exhibiting at least some example structures and features in accordance with this invention.
Figure 2B:
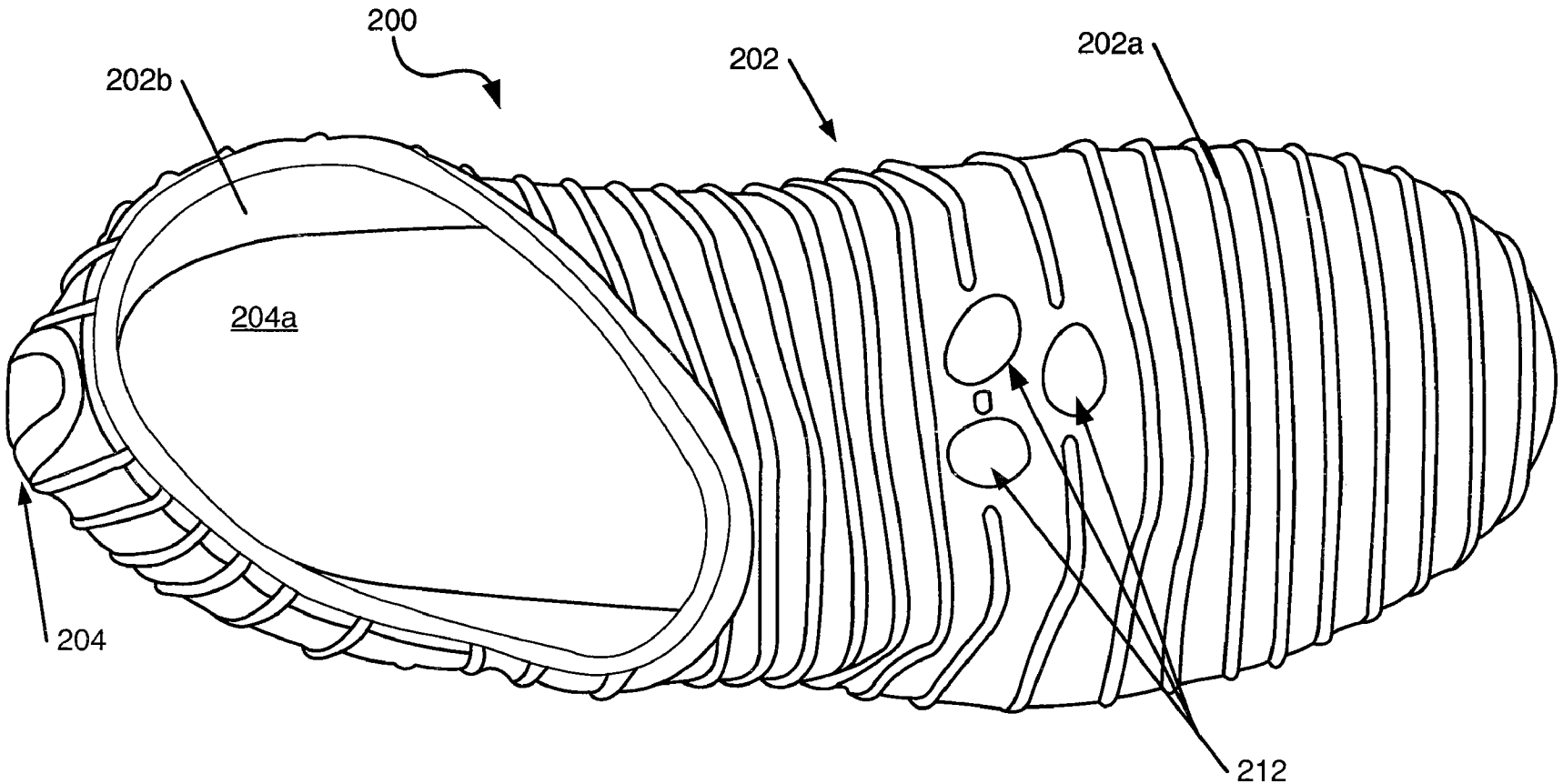
Figure 2C:
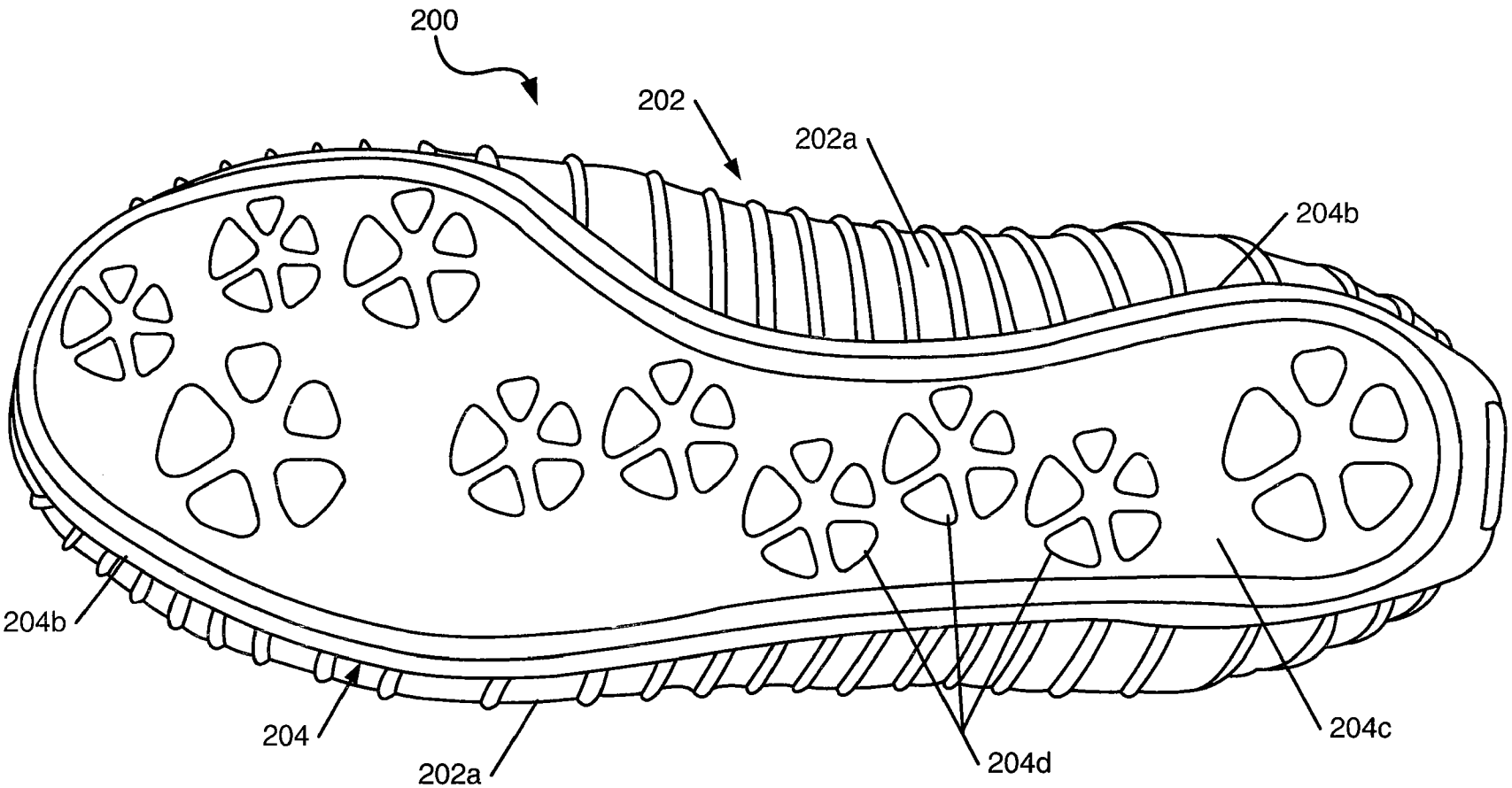
Figure 2D:
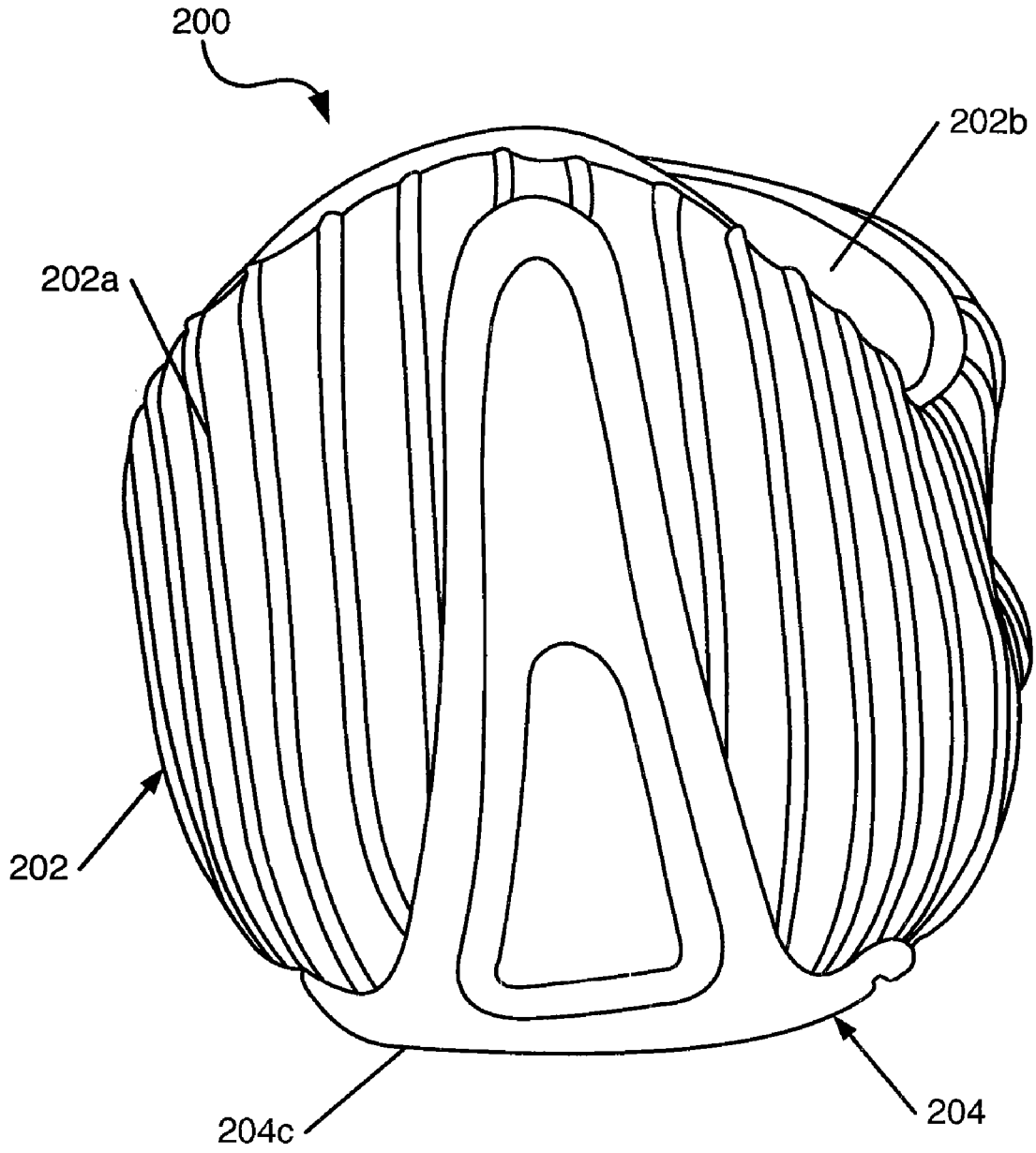

FIG. 4 illustrates an example procedure for preparing openings in the upper member 102 or 202, like openings 112 and 212 provided in the example structures 100 and 200, respectively, described above. In this example procedure, the adhesive material layer 132 is applied to the various pieces of textile material 102*a* and 102*b*, e.g., in a sandwiched configuration. The adhesive layer 132 is provided at locations so as to fully surround the eventual desired location of the opening 112. Heat and/or pressure (and/or other curing conditions) are applied to bind the material layers 102*a* and 102*b* to one another at the adhesive layer 132 (e.g., the adhesive material from layer 132 will migrate into the various material layers 102*a* and 102*b*). Then, one or more openings 112 may be made in the composite material of the upper member 102, e.g., by die cutting, laser cutting, hand cutting, etc. Because of the presence of the adhesive layer 132 migrating into the material layers 102*a* and 102*b*, the edges of the opening 112 will remain crisp and sharp and will resist fraying and unraveling, etc. Of course, a wide variety of opening shapes and/or constructions may be provided in this manner without departing from the invention. In this manner, thick, uncomfortable, and/or air-impermeable seams around opening(s) 112 can be avoided.

III. Conclusion

While the invention has been described with respect to specific examples including presently preferred modes of carrying out the invention, those skilled in the art will appreciate that there are numerous variations and permutations of the above described systems and methods. For example, a wide variety of changes to the structures, materials, relative positioning of various features, production methods and procedures, and the like may be made without departing from this invention. Also, various elements, components, and/or steps described above may be changed, changed in order, omitted, and/or additional elements, components, and/or steps may be added without departing from this invention. Thus, the invention should be construed broadly as set forth in the appended claims.

We claim:

1. An article of footwear, comprising:

an upper member substantially constructed from textile material, wherein the upper member includes an exterior portion substantially constructed from knitted textile material, the exterior portion including a first region having stability ribs integrally formed in the knitted textile material and a second region continuous with the first region, the second region not including stability ribs;

wherein a first portion of the first region extends along a forefoot portion of the exterior portion of the upper member and a second portion of the first region extends along a lateral midfoot side of the exterior portion of the upper member;

wherein a portion of the second region extends along a junction between the upper member and the sole member and between the first portion of the first region and the second portion of the first region on a lateral midfoot side of the exterior portion of the upper member; and a sole member engaged with the upper member.

2. An article of footwear according to claim 1, wherein the second portion of the first region extends along the junction between the upper member and the sole member.

3. An article of footwear according to claim 2, wherein the first region is bordered by the junction and the second region, wherein the second region extends around the first region from a first end of the first region adjacent the junction to a second end of the first region adjacent the junction.

4. An article of footwear according to claim 1, wherein the first region extends along a medial midfoot side of the exterior portion of the upper member.

5. An article of footwear according to claim 4, wherein the first region extends from a rearfoot region of the exterior portion of the upper member to a frontfoot region of the exterior portion of the upper member along the medial midfoot side of the upper member.

6. An article of footwear according to claim 1, wherein the first region extends from a lateral forefoot portion of the exterior portion of the upper member, across the forefoot portion, along a medial side of the upper member, and to a rearfoot portion of the exterior portion of the upper member.

7. An article of footwear according to claim 1, wherein the second region extends at least partially across an instep portion of the exterior portion of the upper member.

8. An article of footwear according to claim 1, wherein the second region extends from a rearfoot portion of the exterior portion of the upper member, along a lateral side of a foot-receiving opening defined in the upper member.

9. An article of footwear according to claim 1, wherein the upper member further includes:

a third region having stability ribs integrally formed in the knitted textile material, the third region independent of the first region and extending along a forefoot portion of the exterior portion of the upper member.

10. An article of footwear according to claim 9, wherein the upper member further includes:

a fourth region having stability ribs integrally formed in the knitted textile material, the fourth region independent of the first region and extending along a medial midfoot portion of the exterior portion of the upper member.

11. An article of footwear according to claim 1, wherein the upper member further includes:

a third region having stability ribs integrally formed in the knitted textile material, the third region independent of the first region and extending from a rearfoot region of the exterior portion of the upper member to a frontfoot region of the exterior portion of the upper member along the medial midfoot side of the upper member.

12. An article of footwear according to claim 1, wherein the upper member further includes:

a third region having stability ribs integrally formed in the knitted textile material, the third region independent of the first region and extending from a lateral forefoot portion of the exterior portion of the upper member, across a forefoot portion of the exterior portion of the upper member, along a medial side of the upper member, and to a rearfoot portion of the exterior portion of the upper member.

13. An article of footwear according to claim 1, wherein the upper member includes an interior portion opposite the exterior portion and at least partially defining a foot-receiving chamber, wherein the interior portion is constructed, at least in part, from an independent piece of textile material from that making the exterior portion of the upper member.

14. An article of footwear according to claim 13, wherein the interior portion of the upper member does not include stability ribs at an area corresponding to the first region of the exterior portion.

15. An article of footwear according to claim 13, wherein the knitted textile material of the exterior portion of the upper member and the independent textile material of the interior portion of the upper member are joined at least partially to one another at a first seam in a stitchless manner.

16. An article of footwear, comprising:

an upper member substantially constructed from textile material, wherein the upper member includes an exterior portion substantially constructed from knitted textile material, the exterior portion including a first region having enhanced stability structures integrally formed in the knitted textile material and a second region continuous with the first region, the second region not including enhanced stability structures;

wherein a first portion of the first region extends along a forefoot portion of the exterior portion of the upper member and a second portion of the first region extends along a lateral midfoot side of the exterior portion of the upper member;

wherein a portion of the second region extends along a junction between the upper member and the sole member and between the first portion of the first region and the second portion of the first region on a lateral midfoot side of the exterior portion of the upper member; and a sole member engaged with the upper member.

17. An article of footwear according to claim 16, wherein the second portion of the first region extends along the junction between the upper member and the sole member.

18. An article of footwear according to claim 17, wherein the first region is bordered by the junction and the second region, wherein the second region extends around the first region from a first end of the first region adjacent the junction to a second end of the first region adjacent the junction.

19. An article of footwear according to claim 16, wherein the first region extends along a medial midfoot side of the exterior portion of the upper member.

20. An article of footwear according to claim 19, wherein the first region extends from a rearfoot region of the exterior portion of the upper member to a frontfoot region of the exterior portion of the upper member along the medial midfoot side of the upper member.

21. An article of footwear according to claim 16, wherein the first region extends from a lateral forefoot portion of the exterior portion of the upper member, across the forefoot portion, along a medial side of the upper member, and to a rearfoot portion of the exterior portion of the upper member.

22. An article of footwear according to claim 16, wherein the second region extends at least partially across an instep portion of the exterior portion of the upper member.

23. An article of footwear according to claim 16, wherein the second region extends from a rearfoot portion of the exterior portion of the upper member, along a lateral side of a foot-receiving opening defined in the upper member.

24. An article of footwear according to claim 16, wherein the upper member includes a foot-receiving opening defined therein, and the second region includes a first opening defined therein, wherein the first opening is independent of the foot-receiving opening.

25. An article of footwear according to claim 24, wherein the first opening is located at an instep portion of the upper member between the foot-receiving opening and a forefoot portion of the upper member.

26. An article of footwear according to claim 16, wherein the upper member further includes:

a third region having enhanced stability structures integrally formed in the knitted textile material, the third region independent of the first region and extending along a forefoot portion of the exterior portion of the upper member.

27. An article of footwear according to claim 26, wherein the upper member further includes:

a fourth region having enhanced stability structures integrally formed in the knitted textile material, the fourth region independent of the first region and extending along a medial midfoot portion of the exterior portion of the upper member.

28. An article of footwear according to claim 16, wherein the upper member further includes:

a third region having enhanced stability structures integrally formed in the knitted textile material, the third region independent of the first region and extending from a rearfoot region of the exterior portion of the upper member to a frontfoot region of the exterior portion of the upper member along the medial midfoot side of the upper member.

29. An article of footwear according to claim 16, wherein the upper member further includes:

a third region having enhanced stability structures integrally formed in the knitted textile material, the third region independent of the first region and extending from a lateral forefoot portion of the exterior portion of the upper member, across a forefoot portion of the exterior portion of the upper member, along a medial side of the upper member, and to a rearfoot portion of the exterior portion of the upper member.

30. An article of footwear according to claim 16, wherein the upper member includes an interior portion opposite the exterior portion and at least partially defining a foot-receiving chamber, wherein the interior portion is constructed, at least in part, from an independent piece of textile material from that making the exterior portion of the upper member.

31. An article of footwear according to claim 30, wherein the interior portion of the upper member does not include enhanced stability structures at an area corresponding to the first region of the exterior portion.

32. An article of footwear according to claim 30, wherein the interior portion of the upper member does not include any enhanced stability structures.

33. An article of footwear according to claim 30, further comprising:

an insole element included within the foot-receiving chamber.

34. An article of footwear according to claim 30, wherein the knitted textile material of the exterior portion of the upper member and the independent textile material of the interior portion of the upper member are joined at least partially to one another at a first seam in a stitchless manner.

35. An article of footwear according to claim 30, wherein the knitted textile material of the exterior portion of the upper member and the independent textile material of the interior portion of the upper member are joined to one another at a foot-receiving opening for the foot-receiving chamber at a first seam in a stitchless manner.

36. An article of footwear according to claim 30, wherein the second region includes a first opening defined therein, wherein the first opening is independent of the foot-receiving opening.

37. An article of footwear according to claim 34, wherein the second region includes a first opening defined therein, and wherein the first opening is independent of the foot-receiving opening and is located at an instep portion of the upper member between the foot-receiving opening and a forefoot portion of the upper member.

38. An article of footwear according to claim 37, wherein edges of the knitted textile material and edges of the independent textile material along the first opening are held together in a stitchless manner.

* * * * *

UNITED STATES PATENT AND TRADEMARK OFFICE

CERTIFICATE OF CORRECTION

PATENT NO. : 7,637,032 B2
APPLICATION NO. : 11/422141
DATED : December 29, 2009
INVENTOR(S) : Sokolowski et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 749 days.

Signed and Sealed this

Ninth Day of November, 2010

David J. Kappos

David J. Kappos
*Director of the United States Patent and Trademark Office*